US008556784B2

(12) United States Patent
Leibowitz

(10) Patent No.: US 8,556,784 B2
(45) Date of Patent: Oct. 15, 2013

(54) STEP SLIDE

(76) Inventor: Barry Leibowitz, Tamarac, FL (US)

( * ) Notice: Subject to any disclaimer, the term of this patent is extended or adjusted under 35 U.S.C. 154(b) by 419 days.

(21) Appl. No.: 12/910,335

(22) Filed: Oct. 22, 2010

(65) Prior Publication Data

US 2012/0100967 A1 Apr. 26, 2012

(51) Int. Cl.
*A63B 21/02* (2006.01)

(52) U.S. Cl.
USPC ..... 482/124; 482/121; 482/126

(58) Field of Classification Search
USPC ..... 482/105, 121, 124, 126
See application file for complete search history.

(56) References Cited

U.S. PATENT DOCUMENTS

| | | | | | |
|---|---|---|---|---|---|
| 1,677,728 | A | | 7/1928 | Robinson | |
| 2,224,103 | A | | 12/1940 | Nilson | |
| 3,529,820 | A | | 9/1970 | Templeton | |
| 4,489,937 | A | * | 12/1984 | Kong | 482/126 |
| 4,733,861 | A | | 3/1988 | Plunkett | |
| 4,757,995 | A | | 7/1988 | Gallagher | |
| 4,815,731 | A | | 3/1989 | Suarez | |
| 4,852,874 | A | | 8/1989 | Sleichter, III | |
| 4,911,434 | A | * | 3/1990 | Herring | 482/105 |
| 5,020,796 | A | | 6/1991 | Ullmann | |
| 5,357,637 | A | | 10/1994 | Moore | |
| D353,172 | S | | 12/1994 | Gaut | |
| 5,490,826 | A | | 2/1996 | Rose | |
| 5,573,487 | A | | 11/1996 | Wallner | |
| 5,643,149 | A | | 7/1997 | Grimaldi | |
| D396,077 | S | * | 7/1998 | Heine | D21/662 |
| 5,807,218 | A | | 9/1998 | Nagatomo | |
| 5,839,978 | A | | 11/1998 | Evangelist | |
| 6,238,324 | B1 | * | 5/2001 | MacMillan | 482/121 |
| 7,695,413 | B1 | * | 4/2010 | Cruz et al. | 482/126 |
| 7,771,331 | B2 | | 8/2010 | Lucano | |

* cited by examiner

*Primary Examiner* — Glenn Richman
(74) *Attorney, Agent, or Firm* — Fleit Gibbons Gutman Bongini & Bianco PL; Paul D. Bianco; Marin Fleit

(57) ABSTRACT

A stance forcing device has a resistance band threaded through a hollow tubular member. Then a first cuff member has an end of the resistance band attached thereto. A second cuff member is attached to the other end of the resistance band. The system has a first padding device attached to the hollow tubular member as well as a second padding device attached to the hollow tubular member. The system has a first cuff member with Velcro material for attachment of the stance forcing device to a user's leg. The first cuff member has a metallic hoop attachment to thread a piece of material for leg attachment. The system has a second cuff member with Velcro material for attachment of the stance forcing device to a user's leg. The second cuff member has a metallic hoop attachment to thread a piece of material for a leg attachment.

14 Claims, 5 Drawing Sheets

STEP SLIDE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the United States Patent and Trademark Office patent file or records, but otherwise reserves all copyrights whatsoever.

BACKGROUND (1) Field of the Invention

Relating to improvements in exercising mechanisms for the legs.

(2) Description of the Related Art

US Patent Citations

U.S. Pat. No. 4,757,995 teaches an apparatus for improving the hitting technique of baseball players.

U.S. Pat. No. 4,815,731 teaches an exercise device for developing various parts of a user's body.

U.S. Pat. No. 5,490,826 to Rose teaches a legwork strengthening and style training device.

U.S. Pat. No. 5,573,487 to Wallner teaches an exercise device.

U.S. Pat. No. 5,807,218 teaches a combination stance limiting and muscle flexing device particularly useful in karate training.

U.S. Pat. No. 5,839,978 teaches a sport training device which has a pair of straps which are secured around the user's ankles.

Current Techniques

Exercise regimens and devices utilized therein teach a variety of exercises for the muscles of the legs that improve performance, heart rate and general muscle tone. However, the aforementioned techniques including those cited above all teach restricting the outward motion of the leg through the use of elastic bands, springs, or similar materials and devices. Thus, there needs to be an improvement that goes beyond this outward motion restriction and yet provides a continuous application of stress to the leg muscles.

BRIEF SUMMARY OF THE INVENTION

An embodiment teaches a stance-forcing device using a resistance band and hollow tubular member having the resistance band threaded there thru. Then a first cuff member has an end of the resistance band attached thereto. Also, a second cuff member is attached to the other end of the resistance band. Further, the system has a first padding device attached to the hollow tubular member as well as a second padding device attached to the hollow tubular member. The stance-forcing device has a first cuff member that has Velcro material for attachment of the stance-forcing device to a leg of a user. Additionally, the first cuff member has a metallic hoop attachment to thread a piece of material for leg attachment. The stance-forcing device has a second cuff member that has Velcro material for attachment of the stance-forcing device to a leg of a user. Additionally, the second cuff member has a metallic hoop attachment to thread a piece of material for a leg attachment using the Velcro described above threaded through said hoop. The attachment of cuff member(s) to resistance band is made by knotting the resistance band through metallic rings sewn into the cuff members and protected by padding on the inner region of the cuff members. The cuff members are attached to the leg of a user by the use of the aforementioned Velcro threaded through two metallic hoops one each attached to each cuff member.

An embodiment teaches a stance forcing device that is taught herein having a resistance band; a hollow tubular member having the resistance band threaded there thru and further having two discs integral with the hollow tubular member and at opposite ends of the hollow tubular member; and a first padding device attached to the hollow tubular member on a central inner axis of the hollow tubular member and adjacent to one of the discs. The stance-force device further comprises a second padding device attached to the hollow tubular member on a central inner axis of the hollow tubular member and adjacent to the other one of the discs.

The stance-forcing device further has a third and fourth padding device attached to the hollow tubular member one on each outside region of the two discs and held in place by a leather sheath covering about one set of inner and outer padding devices and associated disc on each side of the tubular member. The resistance band is threaded through the tubular members, padding devices and leather sheaths on both sides and finally attached to padded cuffs. The first cuff member is attached to one end of the resistance band and a second cuff member attached to the other end of the resistance band wherein the cuff members have Velcro attachment devices for attachment of the cuff members to legs of a user. The attachment of cuff member(s) to the resistance band is made by knotting the ends of the resistance band through metallic rings sewn into the cuff members and protected by padding on the inner region of the cuff members. The cuff members are attached to the leg of a user by the use of the aforementioned Velcro threaded through two metallic hoops one each attached to each cuff member.

DETAILED DESCRIPTION OF THE INVENTION

Figure 1A:
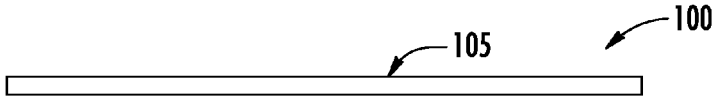
FIG. 1 illustrates the main components of the Step-Slide embodiment describing the independent structure of the various parts.

FIG. 1 illustrates the main components of the Step-Slide embodiment 100 describing the structure of various parts. The Step-Slide 100 is designed to fit between a user's legs so that it restricts the inwards lateral motion of the legs or the bringing together of the legs. The embodiment comprises a variety of parts including: an elastic band, bungee cord or resistance band 105, a motion limiting member 110, a pair (only one is shown for simplicity) of bumpers 130 made from sponge foam, rubber or similar materials, a pair (only one is shown for simplicity) of covering sheaths 150 made from conventional cotton, linen, vinyl or similar materials, a pair (only one is shown for simplicity) of padded Velcro closed leg cuff members shown in FIG. 1I-1J.

Figure 1B:
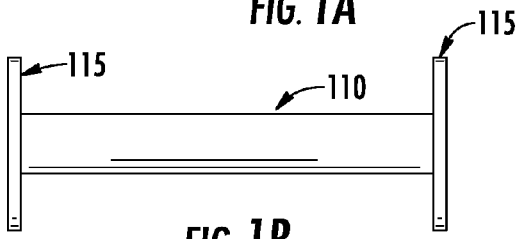
Figure 1C:
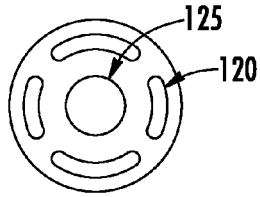

FIG. 1B shows the inner motion limiting member 110 central core, and FIG. 1A shows the exercise band 105. This band 105 is threaded through a cavity that extends lengthwise through the central core of the inner motion-limiting member 110. It is of sufficient length that there is sufficient material in the band 105 to pass through from one side to the other and also to form a knot on either side in association with the padded Velcro closed leg cuff members pair as described below. The size of the inner motion-limiting member restricts the movements of a user thereby forcing him or her to maintain his legs separated at least by the size of the rigid limiting member 110. Thus, inventor contemplates that various sizes of the overall system and limiting member 110 are necessary to service the needs of athletes of different ages, heights and athletic abilities. It is typically made from PVC or similar hard plastics or other manmade materials such as metals or combinations of the foregoing.

As discussed previously, the central core of this member 110 has a hollow cavity running lengthwise from one side of the oblong tube to the other and ending on an opening on either side. An opening on one side is indicated in the drawing FIG. 1C as item 125. A similar corresponding opening is found on the opposite side of the member 110. Additionally, the end of the member 110 has two disc-like 115 extensions that extend outwards and are centered about the hollow cavity 125. Each of these discs 115 is made of similar materials as the member 110 and are formed integrally with it from one plastic extrusion, die or similar plastic manufacturing process. Also, the embodiment teaches one or more perforations in each of the discs 115; in FIG. 1C, there are four chord-like perforations 120 that are disposed concentrically about the opening of the hollow cavity running lengthwise in the tubular member 110. The perforations themselves cut through the entire width of the discs 115 but do not enter the zone of the tubular limiting member 110. These are utilized to attach cords or strips of material that are to be wrapped about and or inside of bumpers 130 so as to strengthen the connection between the central motion limiting member 110 and each of the bumpers 130. In so doing, the wrapping helps prevent the disengagement of both bumpers 130 from the motion-limiting member. The cords or strips of material are optionally made from a variety of materials such as cotton, linen and similar man made items optionally having an adhesive applied so as to strengthen the bond with the bumper.

Figure 1D:
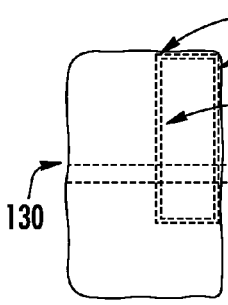
Figure 1E:
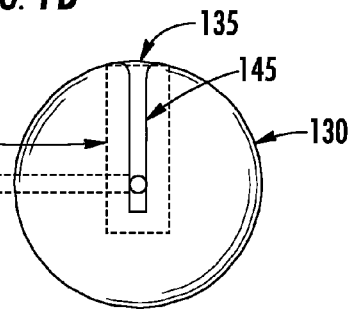

FIG. 1D-1E shows one of the bumpers 130 in side and front views thus illustrating various aspects of the embodiment. These are formed from foam sponge, rubber, foam rubber or similar impact absorbing materials. The bumpers 130 have a hollowed out top region 135 that extends down in rectangular slots 140 cut there through using typical cutting materials for this sort of foam sponge or rubber materials. The slot 140 extends down through until the central part of the bumper 130 in such a fashion that each of the discs 115 slide comfortably into one of the bumpers 130 and their associated slots 140 stopping when the center hollow core of the disc 115 is concentric with the center of the bumper 130. It should be noted that there is a hole that extends through the center of each bumper for the threading of the elastic resistance cord 105 there through. This hole extends from the side of each bumper that does not have a further vertically oriented slot 145 until the side that has the vertical slot that is arranged perpendicularly to the first rectangular slot 140 and extends further down with that other slot 140 beyond the vertical height of the hole. This slot 145 permits the neck of the tubular member 110 to enter the bumpers 130.

Figure 1F:
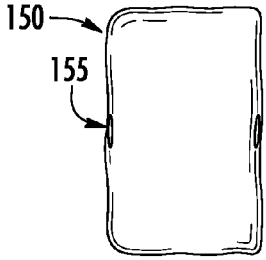
Figure 1G:
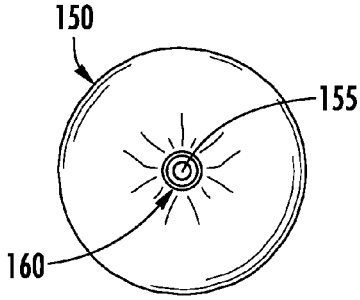
Figure 1H:
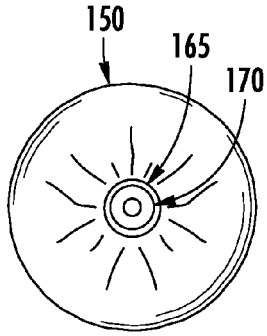

FIG. 1F shows a side view of a covering sheath 150 that has a hole 155 in the center of each side opposite each other. This sheath is made to fit about the bumper 130 and follows the general outline of the bumper 130. A front view of the covering sheath 150 is illustrated in FIG. 1G; it should be noted that this sheath is made of cotton, linen, rubber, vinyl, leather or similar materials cut from one or more pieces that are stitched together and formed to wrap about the bumper 130. The front view shows how it covers the external part of the bumpers 130 following the external shape and dimension of each bumper 130 and has a hole 160 somewhat larger than and at its center matching the hole 155 in each bumper 130 for the threading of the elastic resistance band 105 there through. The edges of the hole 160 are stitched together with linen, cotton, or similar types of materials and are designed to close about the hole 155 in the bumpers so as to permit the threading previously described. The opposite side view FIG. 1G shows a back view that accepts the insertion of the disc 115 and the area of the tubular member 110 having been inserted is represented by item 170 in the figure with a covering sheath central border 165 that is somewhat larger than the external diameter size of the tubular member 110. It covers the external part of the bumpers 130 following the external shape and dimension of each bumper 130 and has a hole 165 somewhat larger than and concentrically matching the hole 155 in each bumper 130 for the threading of the elastic resistance band 105 there through. The edges of the hole 165 are stitched together with linen, cotton, or similar types of materials and are designed to close about the hole 170 representing the outer diameter of the inserted tube 110 in the bumpers so as to permit the threading previously described.

Figure 1I:
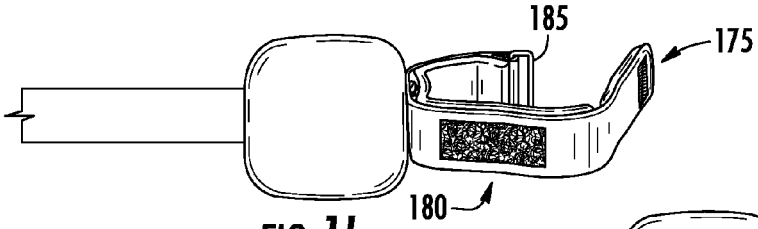
Figure 1J:
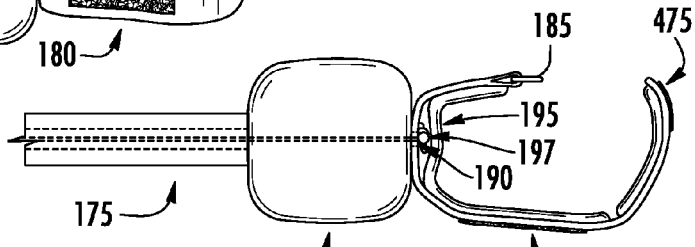

FIGS. 1I-1J illustrate one of a pair (only one is shown for simplicity) of padded Velcro closed leg cuff members. Velcro is a brand name of fabric hook-and-loop fasteners consists of two layers: a 'hook' side, which is a piece of fabric covered with tiny hooks, and a 'loop' side, which is covered with even smaller and 'hairier' loops. When the two sides are pressed together, the hooks catch in the loops and hold the pieces together. Nylon and polyester hooks and loops are the most common type of Velcro fasteners in existence today. FIG. 1I shows a side perspective on one cuff member. On the back side of the figure and at the end of cuff, there is shown a piece of fabric made from one or more of a variety of materials such as cotton, linen, or similar materials that is covered with hairy loops 175 creating one side of the Velcro connection. The front side of the next section 180 is stitched together at the border with the first region 175 and has a pouch on the inner side of the cuff enclosing a sponge foam or foam rubber padding material designed to cushion a wearer's leg from impact; the entire inner surface of the cuff has a pouch integrated with similar padding material as a single piece or in sections of pouches. The rectangular pouch is completely sewn onto a backing material that forms the base of this section and thus the sponge foam will not release there from. The complete or partial back surface of this same region 180 is covered with the Velcro hooks material in an oblong rectangular fashion. This corresponds with the other region 175 previously described to create the locking action of Velcro.

The entire cuff is one long piece of rectangular material made from similar materials as has already been described (cotton, linen, polyester, nylon, spandex) that is sewn together with one or more inner padding pouch(-es) having foam rubber or similar material as padding. One end of the cuff ends in velcro material 175 as previously described. The other end of the cuff member ends in a metallic hoop 185; this hoop is held in place by the threading of the end of the cuff member into and out of the mouth of the hoop and folding the end of the cuff member back onto the cuff until it is sewn onto itself. Since the hoop 185 is a closed ring it will not be able to disengage from the cuff member. The cuff member itself is held in place by interaction with a knot 197. This knot is the end of the resistance band 105 that exits on both sides from the tubular member 110 threaded through the bumper 130 and out of the sheath 150 and through a metallic ring 190. A user can knot this resistance band or choose to add a knotted metallic bolt as a further securing point. It should already be understood with reference to the padding previously described that the user's feet, specifically his or her ankles are completely separated from this knot by the padding 195 that runs along the inner side of the cuff member.

At the location where the resistance band 105 exits the bumper 130 and sheath 150 it encounters the cuff member that has a perforation for acceptance of a metallic ring 190 for holding a neck of an elastic band 105. The metallic ring is sewn into the this material by using perforations in the metallic ring as a means for insertion of stitches in one or more lips of the metallic ring 190 that extend out there from the center location radially. At the point where the cuff member is to have the metallic ring 190, the cuff member is opened and the material itself is cut so as to have an opening suitable for reception of the metallic ring. Then the material is separated into two leaves so as to cover the lips of the metallic ring that will serve as a sewing holding point for the ring. Finally, the metallic ring is inserted there through and it is sewn through the lips of the metallic ring about its circumference to provide holding power to the material and ring connection point. The padding 195 that is made up of foam rubber or similar materials are contained in pouches integral with the cuff member; the pouches are made from cotton, linen, polyester, nylon or similar types of materials and are sewn into the cuff member. The padding and pouches 195 are shown as two separate pieces in the figure but the embodiment has the option of integrating these as one or making them into multiple pieces for ease of use. To activate the cuff member only requires that the section with the hairier loops 175 (475) be threaded by a user into the opening of the hoop 185 and then closed back over and into contact with the section having the hooks of Velcro material 180 (480); as a result, this completes the holding action of the cuff member.

Figure 2:
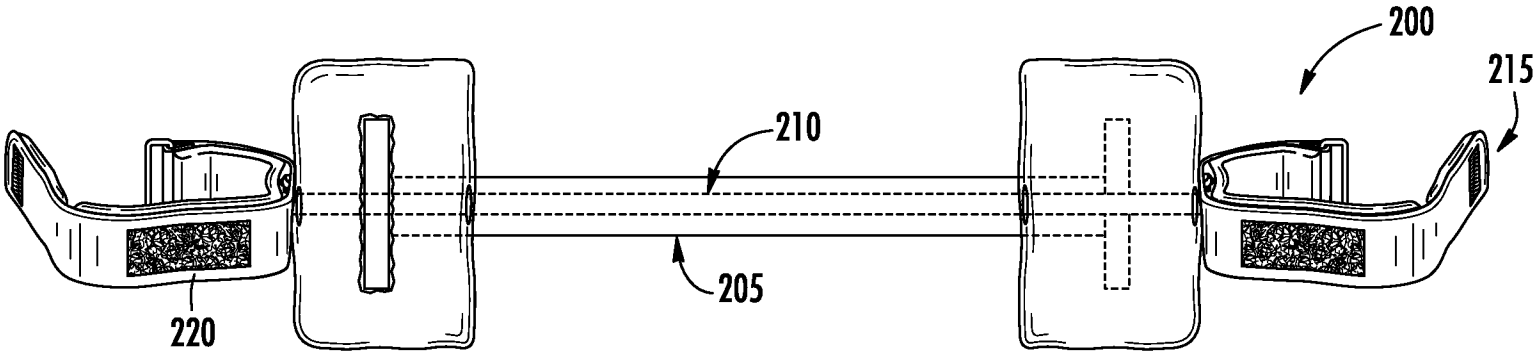
FIG. 2 illustrates the Step-Slide embodiment as organized into a singular integral unit when all of the parts of the embodiment are connected together.

FIG. 2 illustrates one Step-Slide embodiment 200 as organized into a singular integral unit when all of the parts of the embodiment are connected together. The tubular member 205 has been inserted into each of the bumpers as was previously described. An elastic band extends through the entire structure from one cuff member 220 ring knot and ring on through the bumper, the tubular member then through the other bumper and into and through the ring attached to the other cuff member 215 and knotted therethrough. It should be appreciated that upon exiting either metallic ring there is a need for a mechanism to hold the elastic band from backing out back through the ring. Any number of solutions to this problem can include the most simple and easy to implement that of successive knotting of the elastic band with itself until the knot(s) so obtained are large enough to prohibit the release of the elastic band back through the tubular member. Other solutions include the tying of the ends of the elastic band to a piece of metal that is large enough that it will not progress back down through the metallic ring and further down the tube.

Figure 3:
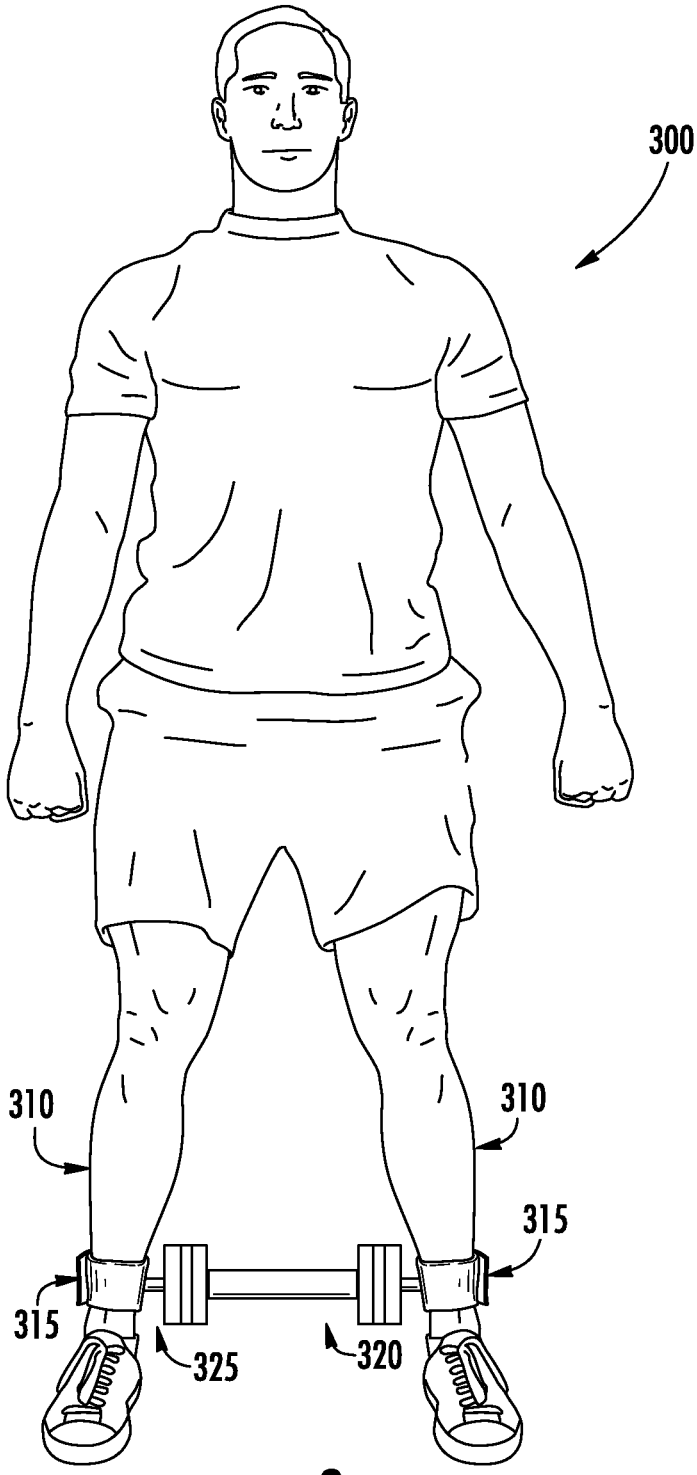
FIG. 3 illustrates the Step-Slide embodiment as attached to the body of a user in order to activate the novelties as taught herein.

FIG. 3 illustrates a man 300 having two legs 310 with a Step-Slide embodiment attached to either leg through the use of cuff members 315. The elastic band 325 extends through a tubular member 320 so as to permit the motion of the user side to side and back and forth. However, now that the Step-Slide has been attached to each leg 310 the user does not have the ability to completely bring his or her legs 310 together. In other words, the addition of the Step-Slide's padded tubular member 320 forces him or her to maintain a stance that has both legs 310 separated further apart then normal as long as the device is worn. In normal usage, the Step-Slide becomes part of an exercise regimen including motions of the body from side to side and back again and many similar types of motion. An exemplary motion includes a user moving one leg 310 to the side activating the resistance band 325 that is threaded through the central tubular member 320 and held in place by the cuff members 315. When he or she has finished this motion, return of the leg 310 back to the original position next to the padded tubular member may be so desired. However, the user may opt to move the other leg 310 out increasing the resistance on the band in both directions and to both legs. Then either one or the other of the legs is returned back to the starting location and so forth.

FIG. 4 illustrates the Step-Slide preferred embodiment describing the several structures of the embodiment. The embodiment is depicted in FIGS. 4A-4E illustrating the various members including shown first in FIG. 4A: two external bumper pieces 400 having a central perforation from one side to another; two internal bumper pieces 410 having a cut 415 for insertion of the central tubular member there through; a central tubular member 425 integrated with two outlying discs 420 and a doubly knotted 440 elastic resistance band threaded through the entire construction as shown. The bumper pieces 400 and 410 are made from foam rubber, foam and or rubber materials that prevent or reduce the effect of impacts to the human body. In FIG. 4B it is shown how the end bumper pieces 400 are placed as their name implies at the outer end of the disk material 420 on either outer side of the tubular member 425 and discs 420 that are made of plastic, PVC or similar materials. The inner bumper pieces 410 are placed as their name implies on the inner side of both discs 420 as they are slid into place on tubular member at the cut 415 that each of them has for this action; alternatively, each may not have this cut and instead are stretched and cajoled into place by workman forcing the material into place. The elastic band is threaded through one end of the tubular member 425 and hangs out both disk ends as shown in FIGS. 4A-4C where it is knotted 440 on both ends; alternatively, a metallic piece like a bolt can be added to the knot so as to secure the piece not flowing back down the tubular member 425. Then, as shown in FIG. 4C a leather sheath or (similar material) is cut from a suitable piece of material and worked into and around the shape of the bumper 400, 410 and disk 420; thus, a complete cover 430 is formed about the three pieces to make an attractive covering for the step slide bumper illustrated at both ends of the tubular member 425. Finally, it should be noted that the sheath 430 has a hole 435 within the sheath 430 for the tubular member 425 on one side and another hole on the other side for the exit of the knotted 440 elastic resistance band for both side bumper assemblies 400, 420, 410 on each side of the tubular member.

Figure 4A:
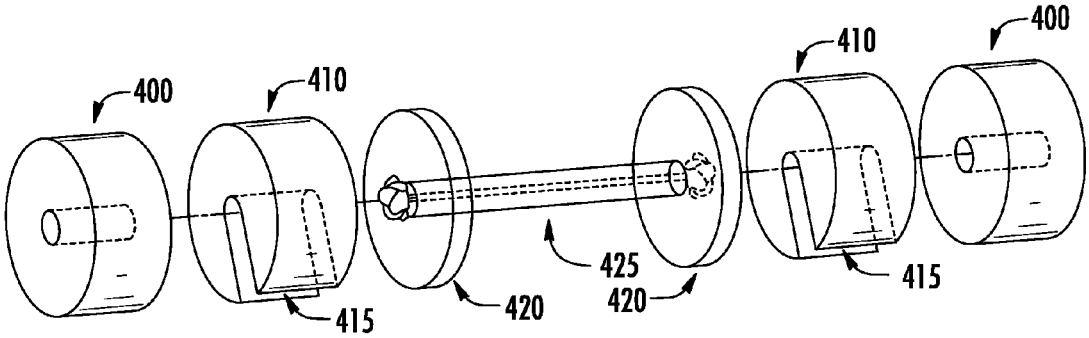
FIG. 4 illustrates the Step-Slide preferred embodiment describing the several structures of the embodiment.
Figure 4B:
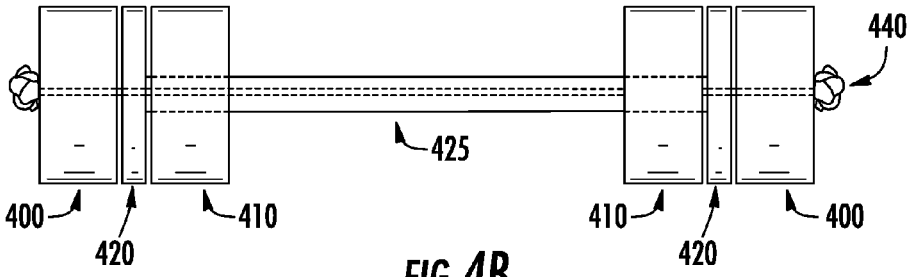
Figure 4C:
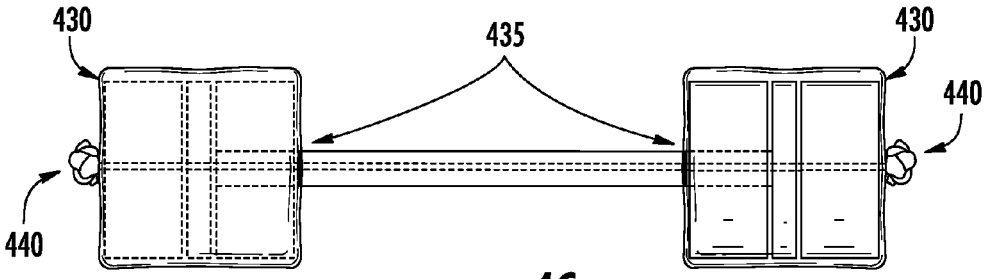
Figure 4D:
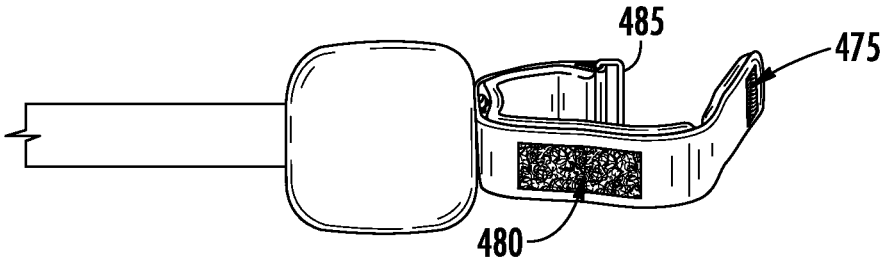

As was described previously, the Step-Slide is designed to fit between a user's legs so that it restricts the inwards lateral motion of the legs to which it is attached. But to do so a mechanism is necessary so as to comfortably attach each of the user's legs to the device. In the embodiment as shown in FIG. 4D, a rectangular strip of material made up of a suitable material (nylon, polyester, cotton) is formed into a leg cuff having an ending at a loop 485 and a beginning at one type of Velcro material 475. A corresponding piece of Velcro material is shown with regards to location 480. If a user wants to activate the holding of the leg when it is placed in the cuff rectangular material, he or she slides the end of the Velcro material 475 into the hoop 485 and folds the rectangular material back onto the other piece of Velcro material at 480 thus engaging the holding power of Velcro. The hoop 485 is held in place by threading one end of the rectangular material through the mouth of the hoop and back onto the rectangular material and sewn thereon so as to lock the hoop in place. As the metallic hoop is a single piece without openings it will not be able to disengage from this material lock.

Figure 4E:
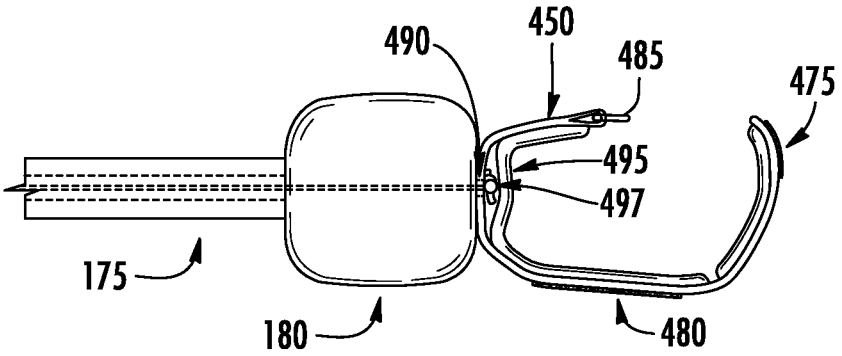

In FIGS. 4D-4E are shown the internal region of the cuff member having sewn pouch(-es) 495 containing or integral padding material in one or more locations. In particular, FIG. 4E shows the padding 495 that acts to shield a user's ankles from impacts due to the motion of the legs and the bumps of ankles against the bumpers materials 400, 410, 420 and 430. This padding is made of similar material as the bumper materials 400, 410 such as foam rubber, rubber, foam or similar materials that can resist and protect from impacts. These one or more pads are sewn or integrated onto the inner region of cuff member 450. They also protect from the knotted resistance band 497 that exits from the bumper materials 400-430 and passes through a metallic ring 490 since the pad sits atop that knotted resistance band end 497.

At the location where the resistance band 497 exits the bumper and sheath it encounters the cuff member 450 that has a perforation for acceptance of a metallic ring 490 for holding a neck of an elastic band. The metallic ring is sewn into the this material by using perforations in the metallic ring as a means for insertion of stitches in one or more lips of the metallic ring 490 that extend out there from the center location radially. At the point where the cuff member is to have the metallic ring 490, the cuff member is opened and the material itself is cut so as to have an opening suitable for reception of the metallic ring. Then the material is separated into two leaves so as to cover the lips of the metallic ring that will serve as a sewing holding point for the ring. Finally, the metallic ring is inserted there through and it is sewn through the lips of the metallic ring about its circumference to provide holding power to the material and ring connection point. The padding 495 that is made up of foam rubber or similar materials are contained in pouches integral with the cuff member; the pouches are made from cotton, linen, polyester, nylon or similar types of materials and are sewn into the cuff member. The padding and pouches 495 are shown as two separate pieces in the figure but the embodiment has the option of integrating these as one or making them into multiple pieces for ease of use. To activate the cuff member only requires that the section with the hairier loops 475 be threaded by a user into the opening of the hoop 480 and then closed back over and into contact with the section having the hooks of Velcro material; as a result, this completes the holding action of the cuff member.

Finally, the foam or foam rubber bumper material described herein is made of latex foam rubber or similar materials. The resistance bands herein are made of latex tubing or latex rubber materials or similar materials. The tubular member is optionally attached via glue to the bumpers; the discs are optionally removed or replaced with a knob like device integral with the tube. Thus, the invention has been described in such clear and precise terms as to enable understanding its fundamental principles.

I claim:

1. A stance forcing device comprising:

a resistance band;

a hollow tubular member having the resistance band threaded there thru, the tubular member having a first flange at a first end portion and a second flange at a second end portion, the first and second flanges cooperating with the ends of the resistance band to maintain the resistance band in the tubular member;

a first cuff member having an end of the resistance band attached thereto;

a second cuff member attached to the other end of the resistance band;

a first padding member located between the first flange and the first cuff member to protect a first leg of a user; and a second padding member located between the second flange and the second cuff member to protect a second leg of the user.

2. The stance forcing device of claim 1, wherein the first cuff member has Velcro material for attachment of the stance forcing device to a leg of a user.

3. The stance forcing device of claim 2, wherein the first cuff member has a metallic hoop attachment to thread a piece of material for leg attachment.

4. The stance forcing device of claim 1 wherein the second cuff member has Velcro material for attachment of the stance forcing device to a leg of a user.

5. The stance forcing device of claim 4, wherein the second cuff member has a metallic hoop attachment to thread a piece of material for a leg attachment.

6. A stance forcing device comprising:

a resistance band;

a hollow tubular member having the resistance band threaded there thru and further having first and second discs located at opposite end portions of the hollow tubular member;

a first padding device positioned on the hollow tubular member on a central inner axis of the hollow tubular member and adjacent to the first disc;

a second padding device positioned on the hollow tubular member on a central inner axis of the hollow tubular member and adjacent to the second disc;

a third padding device positioned on the hollow tubular member on an outside region of the first disc and held in place by a sheath covering about the first and third padding devices and the first disc; and a fourth padding device positioned on the hollow tubular member on an outside region of the second disc and held in place by a sheath covering about the second and fourth padding devices and the second disc.

7. The stance forcing device of claim 6, further comprising:

a first cuff member having an end of the resistance band attached thereto.

8. The stance forcing device of claim 7, further comprising:

a second cuff member attached to the other end of the resistance band.

9. The stance forcing device of claim 7, wherein the first cuff member has Velcro material for attachment of the stance forcing device to a leg of a user.

10. The stance forcing device of claim 9, wherein the first cuff member has a metallic hoop attachment to thread a piece of material for leg attachment.

11. The stance forcing device of claim 8, wherein the second cuff member has Velcro material for attachment of the stance forcing device to a leg of a user.

12. The stance forcing device of claim 11, wherein the second cuff member has a metallic hoop attachment to thread a piece of material for a leg attachment.

13. A stance forcing device comprising:

a resistance band;

a hollow tubular member having the resistance band threaded there thru and further having two discs integral with the hollow tubular member and at opposite ends of the hollow tubular member;

a first padding device attached to the hollow tubular member on a central inner axis of the hollow tubular member and adjacent to one of the discs;

a second padding device attached to the hollow tubular member on a central inner axis of the hollow tubular member and adjacent to the other one of the discs;

a third and fourth padding device attached to the hollow tubular member one on each outside region of the two discs and held in place by a leather sheath covering about one set of inner and outer padding devices and associated disc on each side of the tubular member.

14. The stance forcing device of claim 13, further comprising:

a first cuff member attached to one end of the resistance band;

a second cuff member attached to the other end of the resistance band wherein the cuff members have Velcro attachment devices for attachment of the cuff members to legs of a user.

* * * * *